US005734405A

United States Patent [19]

Suzuki

[11] Patent Number: 5,734,405

[45] Date of Patent: Mar. 31, 1998

[54] INK-JET RECORDING MEDIUM, METHOD OF MANUFACTURING THE SAME, AND INK-JET RECORDING APPARATUS USING THE SAME

[75] Inventor: Akio Suzuki, Yokohama, Japan

[73] Assignee: Canon Kabushiki Kaisha, Tokyo, Japan

[21] Appl. No.: 811,719

[22] Filed: Mar. 6, 1997

Related U.S. Application Data

[63] Continuation of Ser. No. 222,873, Apr. 5, 1994, abandoned.

[30] Foreign Application Priority Data

Apr. 6, 1993 [JP] Japan ..... 5-79579
Apr. 1, 1994 [JP] Japan ..... 6-64907

[51] Int. Cl.[6] ..... B41J 2/01
[52] U.S. Cl. ..... 347/105; 347/16
[58] Field of Search ..... 347/105, 16

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,617,580 | 10/1986 | Miyakawa | 347/16 |
| 4,723,129 | 2/1988 | Endo et al. | 346/1.1 |
| 4,740,796 | 4/1988 | Endo et al. | 346/1.1 |
| 4,935,307 | 6/1990 | Iqbal et al. | 347/105 |
| 5,146,087 | 9/1992 | VanDusen | 347/105 |

FOREIGN PATENT DOCUMENTS

| | | |
|---|---|---|
| 57-122448 | 7/1982 | Japan . |
| 59-123670 | 7/1984 | Japan . |
| 59-138461 | 8/1984 | Japan . |

*Primary Examiner*—Valerie Lund
*Attorney, Agent, or Firm*—Fitzpatrick, Cella, Harper & Scinto

[57] ABSTRACT

An ink jet recording medium has a recording portion prepared by forming a transparent ink absorption layer as an upper layer of an opaque base, and a to-be-detected portion which is at least transparent and corresponds with the detection position of detection means. Even an opaque sheet can be recorded in the same mode as a transparent OHP sheet.

14 Claims, 8 Drawing Sheets

INK-JET RECORDING MEDIUM, METHOD OF MANUFACTURING THE SAME, AND INK-JET RECORDING APPARATUS USING THE SAME

This application is a continuation application of application Ser. No. 08/222,873, filed Apr. 5, 1994, now abandoned.

BACKGROUND OF THE INVENTION

1. Field of the Invention

The present invention relates to an ink jet recording medium, a method of manufacturing the same, and an ink jet recording apparatus using the same.

2. Related Background Art

As recording media for an ink jet recording apparatus, a paper sheet, film, OHP sheet, and the like are known. These recording media normally have a coat layer for absorbing an ink. For example, as a paper sheet, one prepared by coating a pigment such as silica on a base sheet together with a resin as a binder is known. As an OHP sheet, one prepared by coating a water-absorbing resin such as polyvinyl alcohol on a transparent PET film is known.

As an example of the arrangement of an ink jet recording apparatus using such a recording medium, the arrangement disclosed in U.S. Ser. No. 822,617 by the present applicant is known.

In such a recording apparatus, the ink absorption properties (in particular, the ink absorption speed) of a recording medium are important. A medium portion recorded by a recording head is fed while being clamped between feed rollers at the downstream side. At this time, if ink absorption is not completed, an ink is offset (transferred), thus deteriorating an image. Furthermore, the stained rollers may stain the subsequent recording sheets.

As for the ink absorption speeds of recording media, an OHP sheet has a lower speed than that of a paper sheet. As described above, a paper sheet, which uses a pigment in a coat layer, has a considerably high absorption speed since an ink enters micropores of the coat layer. In other words, the OHP sheet normally has inferior ink absorption properties to those of the paper sheet.

However, since the pigment-based coat layer becomes opaque due to scattering-of light, it cannot be used as a coat layer of the OHP sheet. For this reason, an OHP sheet is normally manufactured by coating a resin such as polyvinyl alcohol having high ink absorption properties. However, the ink absorption speed of such a transparent water-absorbing resin is considerably lower than that of the pigment-based coat layer. When an image with a high density is printed, the surface of the sheet must be left untouched for several minutes after the print operation.

In order to feed an OHP sheet having a low absorption speed, an apparatus which detects the type of sheet to be used, and changes a sheet feed method in accordance with the detection result is known.

For example, an LED and a light-receiving element are attached to a recording carriage. When a sheet is fed, the carriage is scanned once prior to an actual print operation to radiate light from the LED onto a sheet, and light reflected by the sheet is detected. If a platen comprises a reflection plate with a high reflectance, the amount of light reflected by a paper sheet becomes small, and the amount of light reflected by an OHP sheet becomes large.

If the platen is painted in black, the amount of light reflected by a paper sheet becomes large, and the amount of light reflected by an OHP sheet becomes small. The type of recording medium can be discriminated based on the difference between the amounts of reflected light.

When a paper sheet is detected, a normal feed operation is performed. When an OHP sheet is detected, downstream feed rollers are separated, so that nothing touches the surface of the printed sheet, and the sheet is fed by only upstream rollers. In another apparatus, the downstream rollers are designed, so that two end portions and a central portion can be separated from each other. In this apparatus, when an OHP sheet is detected, only the central roller portion is separated away from the sheet, and a feed operation at the downstream side is performed by only roller portions at the two end portions corresponding to non-image portions.

In this manner, a recording medium with a low absorption speed can be fed without deteriorating an image.

In some apparatuses, in addition to the feed method, color processing parameters and gradation correction curves are changed in accordance with the type of recording medium so as to correct an image signal, and the voltage, pulse width, and pulse waveform of a driving signal to be supplied to a recording head are changed in accordance with the type of recording medium so as to correct the ink ejection amount. For example, when an OHP sheet is detected, an image signal or a driving signal is corrected so as to decrease the ink amount printed per unit area. In this case, color correction parameters may be changed to correct a difference in color development.

Along with the widespread use of the ink jet recording apparatus, demand for various recording media is increasing. For example, a golden film, a silver film, and the like are much in demand in the design field, and white, lustrous films are much in demand as alternative base materials of silver chloride photographs.

It is easy to manufacture these film, and a coat layer used in an OHP sheet can be coated on a golden film, silver film, white film, and the like. Since the coat layer of the OHP sheet is transparent, the color of a base layer directly appears as the color of a recording sheet.

However, since ink jet films which are manufactured as described above are opaque although they have an ink absorption speed as low as that of an OHP sheet, such films are determined to be paper sheets by the above-mentioned apparatus, and the printed ink is offset by downstream feed rollers, thus deteriorating an image. Also, automatic correction of an image signal and a driving signal cannot be executed for the same reason as described above.

SUMMARY OF THE INVENTION

The present invention has been made to solve the above-mentioned problems, and has as its object to provide an ink jet recording medium which does not deteriorate an image even when it is used in an ink jet recording apparatus for selecting a recording mode in accordance with the type of recording medium which is optically detected, and a method of manufacturing the same.

It is another object of the present invention to provide an ink jet recording apparatus which can prevent deterioration of an image even when a recording medium prepared by forming an ink absorption layer with low ink absorption properties on an opaque base is used.

According to the present invention, there is provided an ink jet recording medium which can be used in an ink jet recording apparatus including detection means for optically detecting a type of recording medium, and selection means for selecting a recording mode in accordance with a detection result of the detection means, comprising a recording portion prepared by forming a transparent ink absorption layer on an opaque base, and a to-be-detected portion which is at least transparent and corresponds with a detection position of the detection means, whereby recording can be performed on even an opaque sheet in the same recording mode as that for an OHP sheet.

According to the present invention, there is also provided an ink jet recording medium which can be used for an ink jet recording apparatus having detection means for optically detecting a type of recording medium, and means for selecting a recording mode in accordance with a detection result from the detection means, comprising a recording portion prepared by stacking an opaque base and a transparent ink absorption layer, and a to-be-detected portion which is at least transparent and corresponds with a detection position of the detection means.

According to the present invention, there is also provided an ink jet recording medium comprising a recording portion prepared by stacking an opaque base and a transparent ink absorption layer, and a transparent to-be-detected portion.

According to the present invention, there is also provided a method of manufacturing an ink jet recording medium, comprising the steps of: masking a portion of a transparent base with a mask member; forming a deposition layer on the masked base; forming a dyestuff layer on the formed deposition layer; forming a transparent ink absorption layer on the formed dyestuff layer; and peeling the mask member.

According to the present invention, there is also provided a method of manufacturing an ink jet recording medium, comprising the steps of: preparing a recording portion obtained by stacking a deposition layer, a dyestuff layer, and an ink absorption layer on a transparent base; and adhering a transparent to-be-detected portion to the recording portion.

According to the present invention, there is also provided a method of manufacturing an ink jet recording medium, comprising the steps of: preparing a recording portion obtained by stacking an ink absorption layer on one surface of a transparent base; forming an opaque dyestuff layer on the other surface of the base.

According to the present invention, there is also provided an ink jet recording apparatus which can use a first recording medium prepared by stacking a transparent base and a transparent ink absorption layer with poor absorption properties, a second recording medium having an ink absorption layer with high ink absorption properties, and a third recording medium prepared by stacking an opaque base and a transparent ink absorption layer with poor absorption properties, and which comprises detection means for optically detecting a type of the recording medium, selection means for selecting one of first and second recording modes in accordance with a detection result of the detection means, and recording means for ejecting an ink, wherein the third recording medium used in the recording apparatus has a to-be-detected portion which is at least transparent and corresponds with a detection position of the detection means, and the selection means selects the first recording mode when the first and third recording media are used, and selects the second recording mode when the second recording medium is used.

DESCRIPTION OF THE PREFERRED EMBODIMENTS

The preferred embodiments of the present invention will be described hereinafter. First, the arrangement of an apparatus which can applied to the embodiments will be described below.

Figure 2:
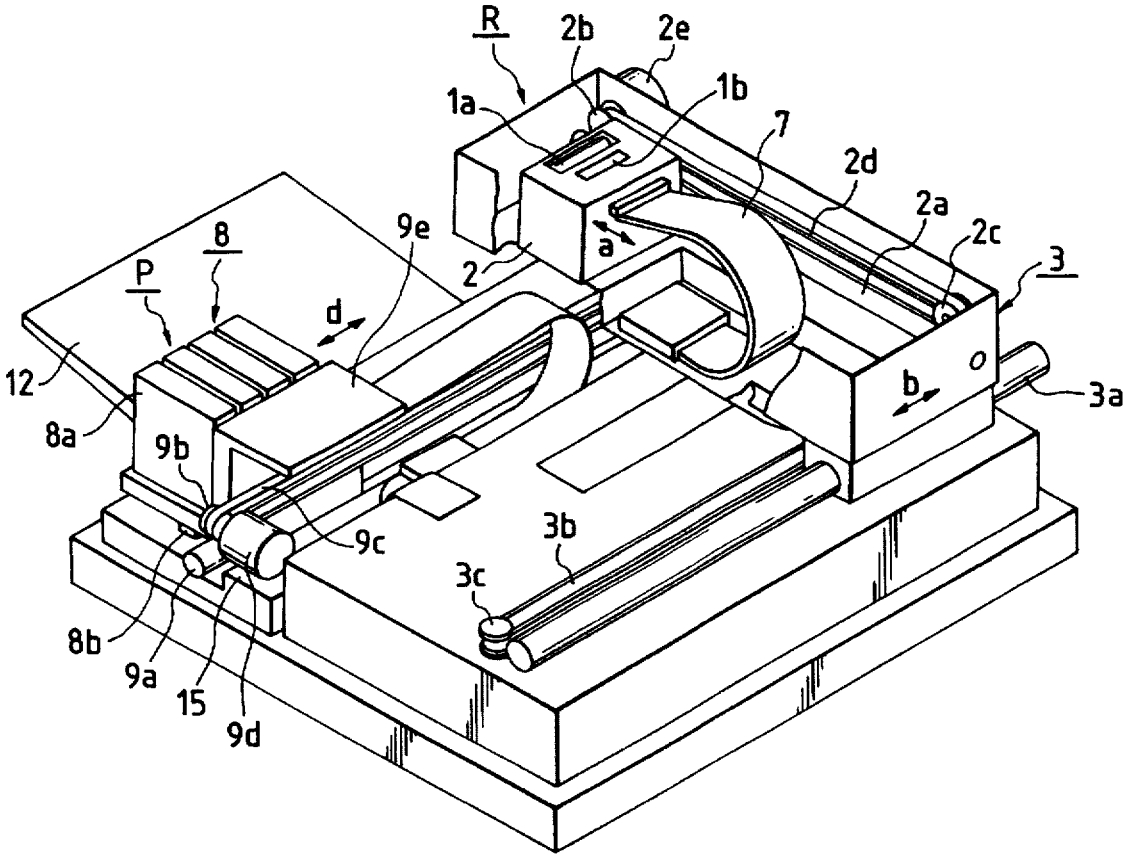
FIG. 2 is a perspective view showing the arrangement of a recording apparatus to which the present invention can be applied.
Figure 3:
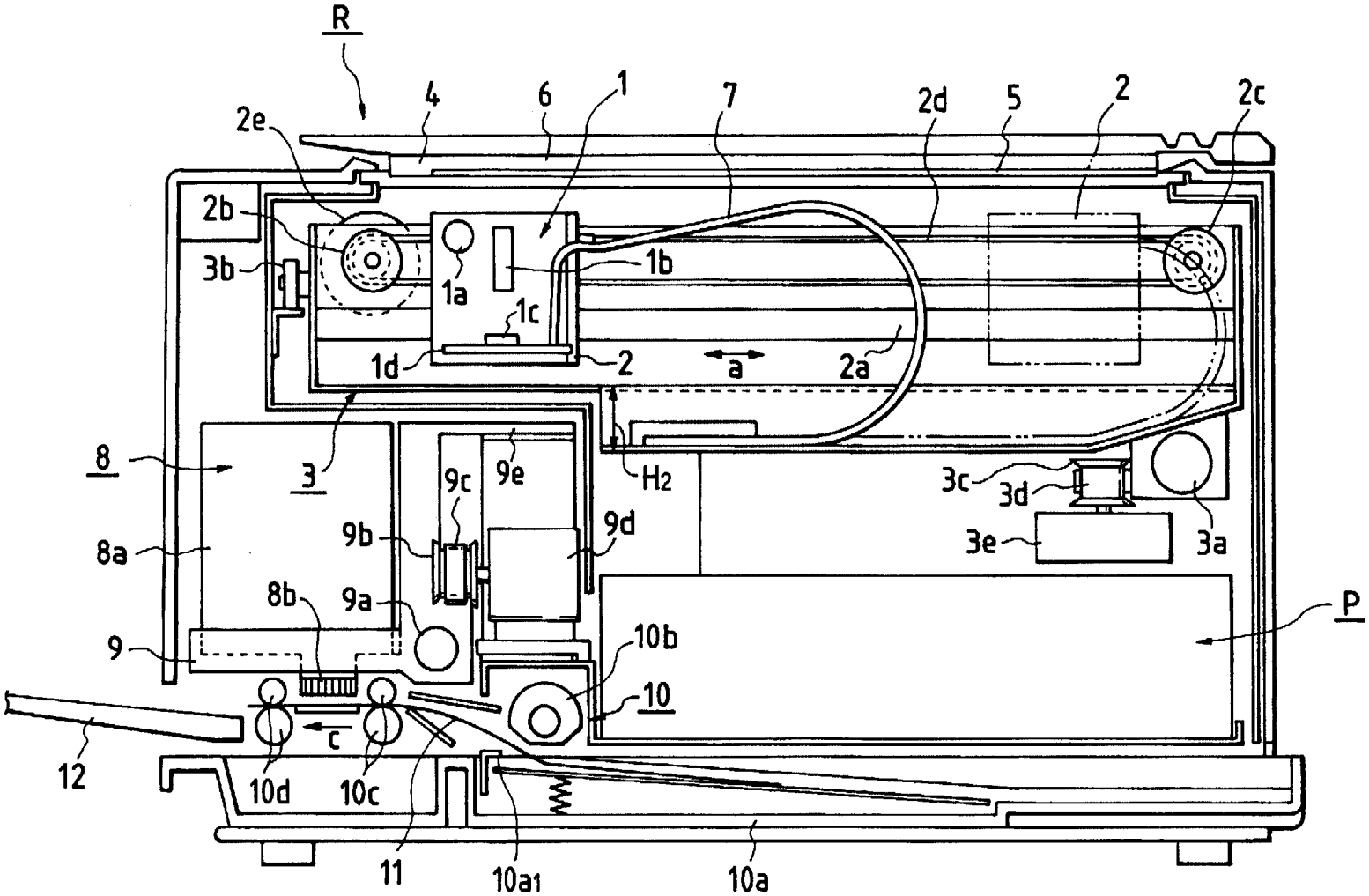
FIG. 3 is a sectional view of the recording apparatus shown in FIG. 2.

FIG. 2 is a perspective view showing the arrangement of a recording apparatus, and FIG. 3 is a sectional view thereof. The overall arrangement of the apparatus will be explained. The apparatus comprises a reading device R and a recording device P. In the arrangement of the reading device R, a reading means 1 is arranged on a reading carriage 2, and the carriage 2 is reciprocally movable in the main scanning direction (in directions indicated by an arrow a). The carriage 2 is attached to a reading unit 3, and the unit 3 is reciprocally movable in the sub-scanning direction (in directions indicated by an arrow b).

Therefore, when an original 5 is placed with its image surface facing down on an original table glass 4 attached to the upper surface of the apparatus and is fixed and set by a cover 6, and a copy switch (not shown) is depressed, the carriage 2 moves in the main scanning direction to read an original image for one line, and transmits the read information to a control system (not shown) via a signal cable 7. Upon completion of the reading operation of the original image for one line, the carriage 2 is returned to the home position, and the reading unit 3 moves by one line in the sub-scanning direction. Thereafter, the reading operation of an image in the next and subsequent lines is similarly performed.

In the arrangement of the recording device P, a recording means 8 is mounted on a recording carriage 9, and a recording sheet 11 is fed to the position of the recording means 8 by a sheet feed means 10.

Therefore, when a reading signal from the reading device R is transmitted via the signal cable 7, the recording sheet 11 is fed by the feed means 10 in the direction of an arrow c. When the sheet 11 reaches the recording position, the recording carriage 9 reciprocally moves in the directions of an arrow d in FIG. 2, and the recording means 8 is driven in accordance with an image signal in synchronism with the movement of the carriage 9, thereby recording an image on the recording sheet 11. Upon completion of recording for one line, the recording sheet 11 is fed by one line in the direction of the arrow c, and the recording operation is similarly performed. Thereafter, the recorded sheet 11 is ejected onto a sheet ejection tray 12.

The bottom portion of the recording unit 3 locally projects to a level lower than the highest level portion of the recording device P, and one end of the signal cable 7 is connected and fixed to the projecting portion.

The arrangement of the respective units will be sequentially described in detail below.

(Reading Means)

The reading means 1 optically reads information on the original 5, and converts the read information into an electrical signal. In the arrangement of the reading means 1, as shown in FIG. 3, a light source 1*a* radiates light onto the original surface, and light reflected by the original surface is detected by a photoelectric conversion element 1*c* such as a CCD via a lens 1*b*. The detected light is converted into an electrical signal by the element 1*c*, and the converted electrical signal is supplied to the recording device P as an image signal.

Note that the photoelectric conversion element 1*c* is attached to a board 1*d*, and the other end of the signal cable 7 is connected to the board 1*d*.

(Reading Carriage)

The reading carriage 2 is used for moving the reading means 1 in the main scanning direction, and the reading means 1 is attached thereto. The reading carriage 2 is slidably attached to a main scanning rail 2*a*. A driving pulley 2*b* and a driven pulley 2*c* are respectively attached near the two end portions of the rail 2*a*, and a timing belt 2*d* looped between the two pulleys 2*b* and 2*c* is connected to the reading carriage 2. Furthermore, a reading carriage motor 2*e* is coupled to the driving pulley 2*b*.

Therefore, when the carriage motor 2*e* is rotated in the forward or reverse direction, the carriage 2 reciprocally moves in the main scanning direction while being guided along the rail 2*a*.

(Reading Unit)

The reading unit 3 is used for moving the carriage 2 in the sub-scanning direction. The main scanning rail 2*a*, the pulleys 2*b* and 2*c*, and the carriage motor 2*e* are attached to the reading unit 3. One end of the reading unit 3 is slidably attached to a sub-scanning rail 3*a*, and a guide roller 3*b* is attached to the other end of the unit 3. The roller 3*b* is movable along a guide portion 13*a* formed on an apparatus main body frame 13. A driving pulley 3*c* and a driven pulley (not shown) are attached near the two end portions of the sub-scanning rail 3*a*, and a timing belt 3*d* is looped between the two pulleys. The belt 3*d* is connected to the reading unit 3, and a unit motor 3*e* is coupled to the driving pulley 3*c*.

Therefore, when the unit motor 3*e* is rotated in the forward or reverse direction, the reading unit 3 reciprocally moves in the sub-scanning direction (in a direction perpendicular to the main scanning direction as the moving direction of the carriage 2) along the sub-scanning rail 3*a*.

(Recording Means)

The recording means is used for recording an ink image on the recording sheet 11, and adopts an ink jet recording system in this embodiment.

The ink jet recording system comprises ink ejection orifices for ejecting recording ink droplets as flying ink droplets, ink channels communicating with the ejection orifices, and ejection energy generating means, arranged in corresponding portions of the ink channels, for applying ejection energy for flying an ink in the channels. Ink droplets are ejected by driving the ejection energy generating means in accordance with an image signal, thereby recording an image.

As the ejection energy generating means, a method using pressure energy generating means such as an electromechanical energy converting element (e.g., a piezoelectric element), a method using electromagnetic energy generating means for radiating an electromagnetic wave such as a laser beam onto an ink, and causing the ink to absorb the electromagnetic wave to form flying ink droplets, a method using thermal energy generating means such as an electrothermal energy converting element, and the like are known. Of these methods, the method using thermal energy generating means such as an electrothermal energy converting element allows a high-density arrangement of ejection orifices, and realizes a compact structure of a recording head.

Recording heads 8*b* are attached to the lower ends of corresponding ink cartridges 8*a*. When liquid inks are stored in the ink cartridges 8*a*, and the recording heads 8*b* are driven, electrothermal energy converting elements generate heat in accordance with an image signal from the reading device R, and ink droplets fly downward from the ejection orifices in correspondence with the generated heat.

When the recording carriage 9 is scanned in the main scanning direction (in the direction of an arrow d in FIG. 2) in synchronism with the driving operation of the recording head 8*b*, a recording operation for a width of 8.128 mm is performed per scan on the recording sheet 11.

(Recording Carriage)

The recording carriage 9 is used for reciprocally moving the recording means 8 in the main scanning direction, and is slidably attached to a main scanning rail 9*a*, as shown in FIG. 2. The recording means 8 is mounted on the recording carriage 9.

A driving pulley 9*b* and a driven pulley (not shown) are attached near the two end portions of the main scanning rail 9*a*, and a timing belt 9*c* looped between the two pulleys is connected to the recording carriage 9. Furthermore, the driving pulley 9*b* is coupled to a recording carriage motor 9*d*.

Therefore, when the carriage motor 9*d* is rotated in the forward or reverse direction, the recording carriage 9 reciprocally moves in the main scanning direction while being guided along the rail 9*a*. Note that an electrical signal to the recording head 8*b* is transmitted via a signal cable 14. As shown in FIG. 2, one end of the cable 14 is connected to an arm 9*e* which is formed on a portion of the recording carriage 9 at substantially the same level as the ink cartridges 8*a*. The other end of the cable 14 is connected and fixed to a recording unit 15.

(Sheet Feed Means)

The sheet feed means 10 feeds the recording sheet 11. In the arrangement of the sheet feed means 10, as shown in FIG. 3, a cassette 10*a* is detachably attached to the lower portion of the apparatus, and a plurality of recording sheets 11 are stacked and stored in the cassette 10*a*. The recording sheets 11 are separated and fed by a pickup roller 10*b* and a separation pawl 10*a*1 arranged at the distal end of the cassette 10*a* one by one in the direction of an arrow c, and are fed by pairs of feed rollers 10*c* and 10*d* which are respectively arranged at the upstream and downstream sides, in the sheet feed direction, of the recording heads 8*b*.

(Recovery System Unit)

Figure 4:
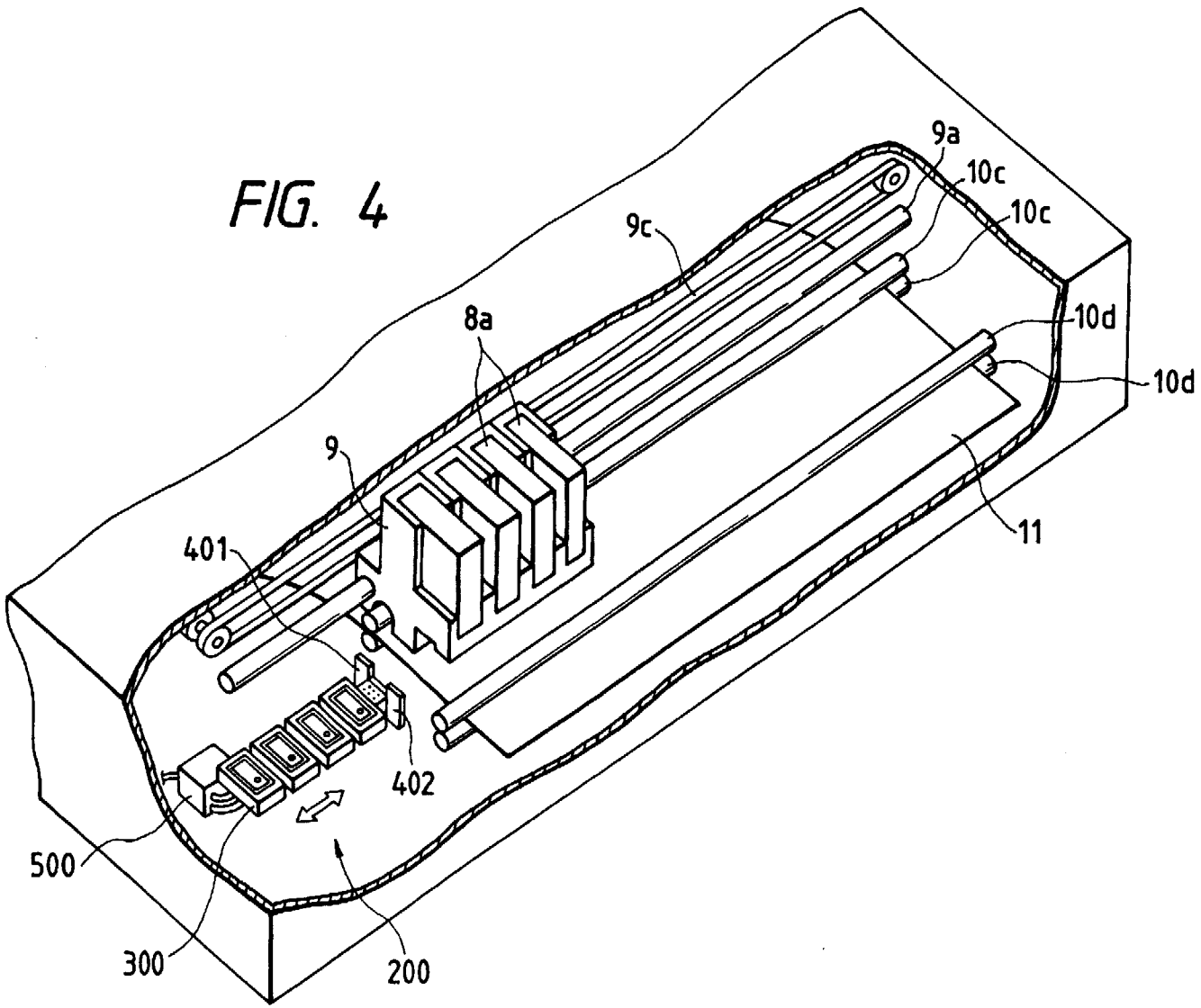
FIG. 4 is a partially cutaway perspective view showing a recovery system unit.
Figure 5:
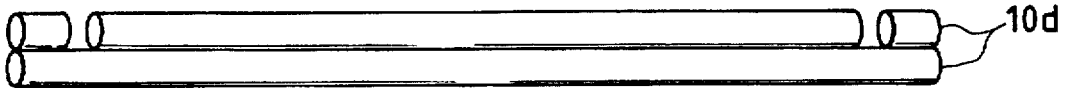
FIG. 5 is a perspective view showing feed rollers.

FIG. 4 is a partially cutaway perspective view for explaining the positional relationship between a recovery system unit 200 and the recording carriage, and the schematic arrangement of the unit 200.

In the recovery system unit, cap units 300 are arranged in correspondence with the plurality of ink cartridges 8*a* having the recording heads 8*b*. The cap units 300 are movable in the right-and-left direction in FIG. 4 upon movement of the recording carriage 9, and are also movable in the up-and-down direction in FIG. 4. When the recording carriage 9 is located at the home position, the cap units 300 are joined to the corresponding recording heads **8*b* to cap them. Blades 401 and 402 are used for wiping the ejection orifice formation surfaces of the recording heads 8*b***.

(First Embodiment)

Figure 1:
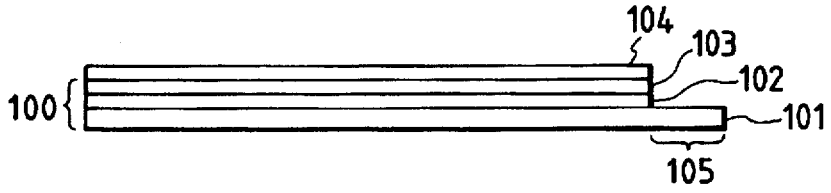
FIGS. 1 and 8 are respectively a sectional view and a plan view showing the first embodiment of the present invention.

FIG. 1 shows an ink jet golden film according to the first embodiment of the present invention. Referring to FIG. 1, a transparent ink absorption layer 104 consisting of polyvinyl alcohol as a major component is formed on a golden film 100. The golden film 100 has three layers, i.e., a 100-μm thick transparent PET film 101, an Al deposition layer 102, and a yellow dyestuff layer 103. That is, the deposition layer 102 and the dyestuff layer 103 constitute an opaque base.

The transparent ink absorption layer 104 having a thickness of about 20 μm is coated on the golden film 100.

In this film, a portion 105 consists of only a transparent PET (polyethylene terephthalate), and serves as a detection portion. Therefore, when the golden film 100 is fed so that the transparent portion 105 serves as a leading end portion, an OHP sheet is detected by sheet type detection prior to a print operation. Thus, the feed rollers at the downstream side are removed or separated, and an ink can be prevented from being offset after the print operation.

In order to manufacture such a sheet, a portion, corresponding to the portion 105, of a transparent PET is masked with, e.g., a tape, and after the deposition layer 102, the dyestuff layer 103, the ink absorbing layer 104 are stacked thereon, the tape can be removed.

The size of the transparent portion 105 is determined depending on the arrangement and sequence of a machine to which the sheet is fed. For example, in a machine which performs sheet type detection in a hatched portion of FIG. 8 upon feeding of an A4-size sheet, the transparent portion needs a minimum length of 23 mm. In this case, it is preferable that the transparent portion have a length of 25 mm or more in consideration of feed precision and the like.

An actual operation will be described below with reference to FIG. 8 described above and the flow chart in FIG. 10.

Figure 8:
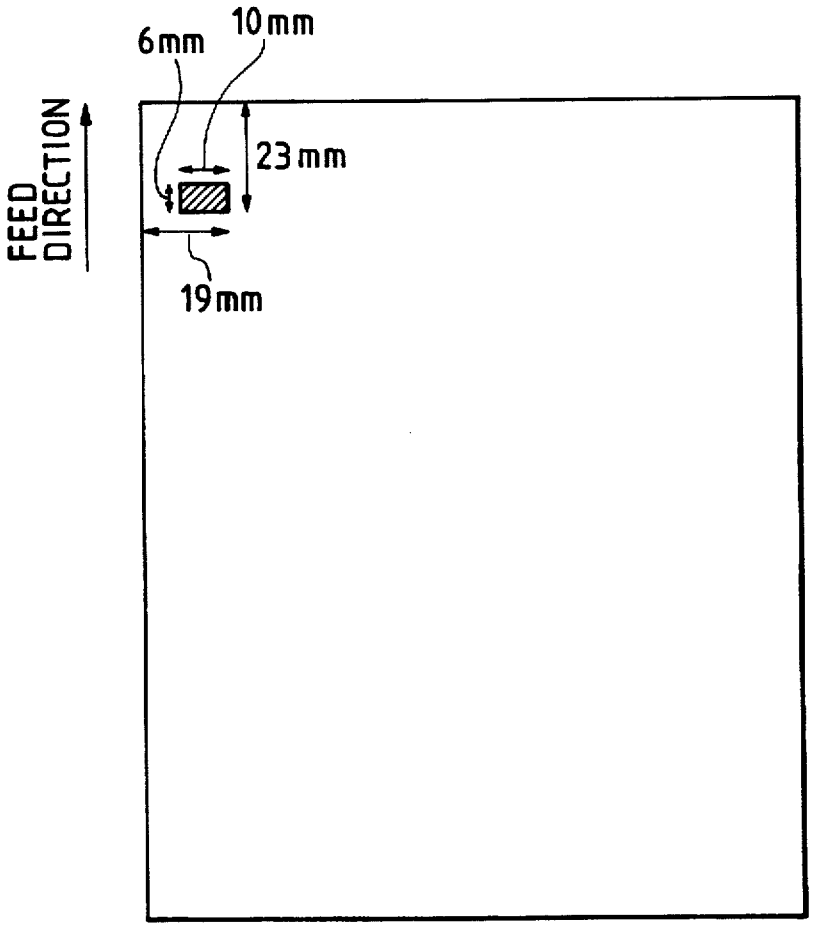

When the control is started in step S1, and a recording medium is fed, the recording medium is fed to a position where the carriage passes the hatched portion in FIG. 8, and is temporarily stopped. Then, the type of sheet is detected while main-scanning the carriage (step S2). If an OHP sheet is determined based on the detection result (steps S3 and S4), the feed rollers **10*d*** at the downstream side are separated to feed the recording medium by only their end portions, and masking coefficients, UCR coefficients, and the pattern of a gradation correction curve are set in correspondence with the OHP sheet (steps S5 and S6). These parameters are designed in correspondence with the characteristics of an OHP sheet to be used. Normally, these parameters are designed to attain an ink amount which can improve color reproducibility and can prevent ink overflow.

If a normal paper sheet is determined (steps S3 and S7), the feed rollers at the downstream side are not separated, and the above-mentioned image processing parameters are set to be ones which are optimally designed in correspondence with the characteristics of a paper sheet to be used (steps S5 and S6). Thereafter, a recording operation is performed in step S8 in accordance with the feed mode and the image processing mode which are set in steps S5 and S6 in correspondence with the recording mode, and the flow ends in step S9.

(Second Embodiment)

Figure 6:
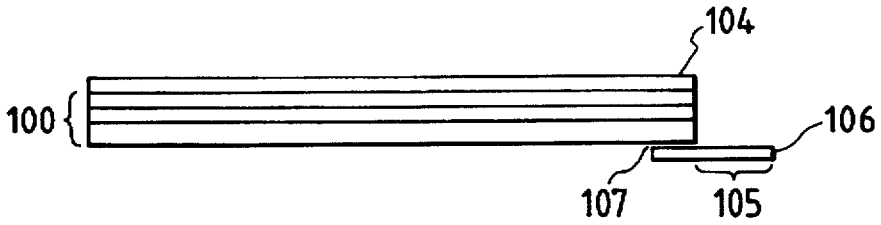
FIG. 6 is a sectional view showing the second embodiment of the present invention.

The second embodiment will be described below with reference to FIG. 6. Referring to FIG. 6, a transparent PET film 106 is attached to the film 100 via an adhesive layer 107. The adhesive layer 107 to be used has a relatively small peeling strength of adhesive coupling, as disclosed in Japanese Laid-Open Patent Application No. 57-122448. With this structure, a transparent portion which becomes unnecessary after the print operation can be easily removed.

(Third Embodiment)

Figure 7:
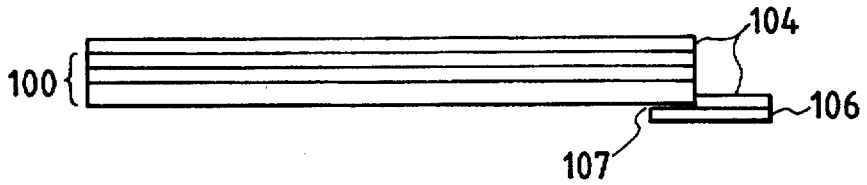
FIG. 7 is a sectional view showing the third embodiment of the present invention.

FIG. 7 shows the third embodiment. In the third embodiment, the transparent ink absorption layer 104 is also formed on the transparent layer 106.

In each of the first and second embodiments, no ink absorption layer is formed on a transparent layer for detection. The structure of each of the first and second embodiments poses no problem when a print operation is started from a portion with the ink absorption layer by performing a sub-scanning operation after detection using the sensor on the carriage.

However, when the print operation is started from the detection position or when the sensor is arranged at the leading end portion of the carriage, and the print operation is performed by the head behind the sensor while performing detection in a single main scanning operation, an ink remains on the transparent layer, resulting in inconvenience.

In the third embodiment, since the ink absorption layer 104 is also formed on the transparent PET layer 106, an ink is absorbed several minutes after the print operation, and the transparent portion 106 can be removed more easily.

(Fourth Embodiment)

Figure 13:
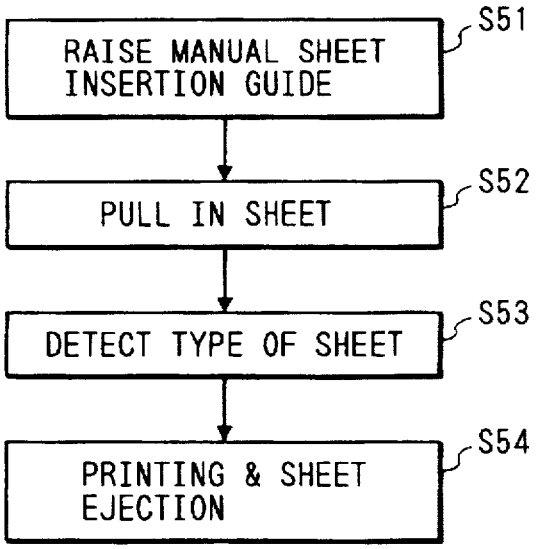
FIG. 13 is a flow chart showing the operation of the fourth embodiment.
Figure 11:
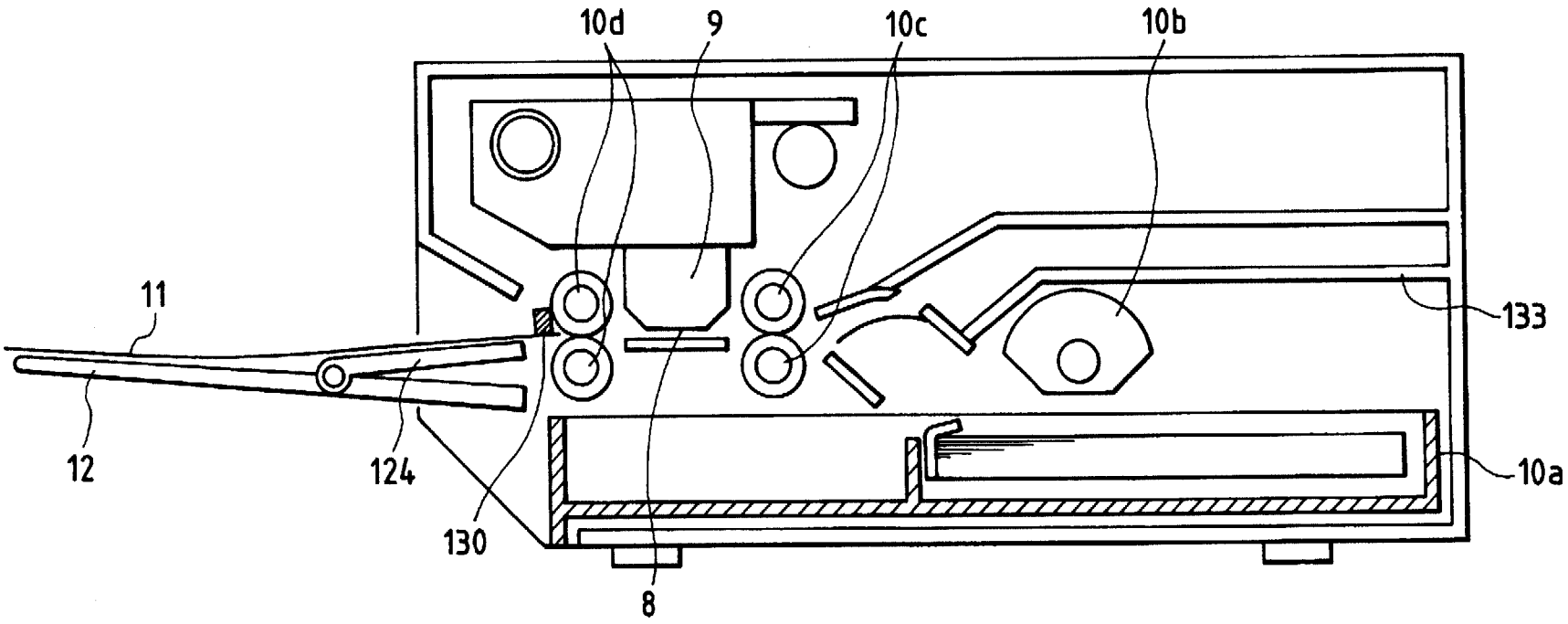
FIGS. 11 and 12 are sectional views showing the fourth embodiment of the present invention.
Figure 12:
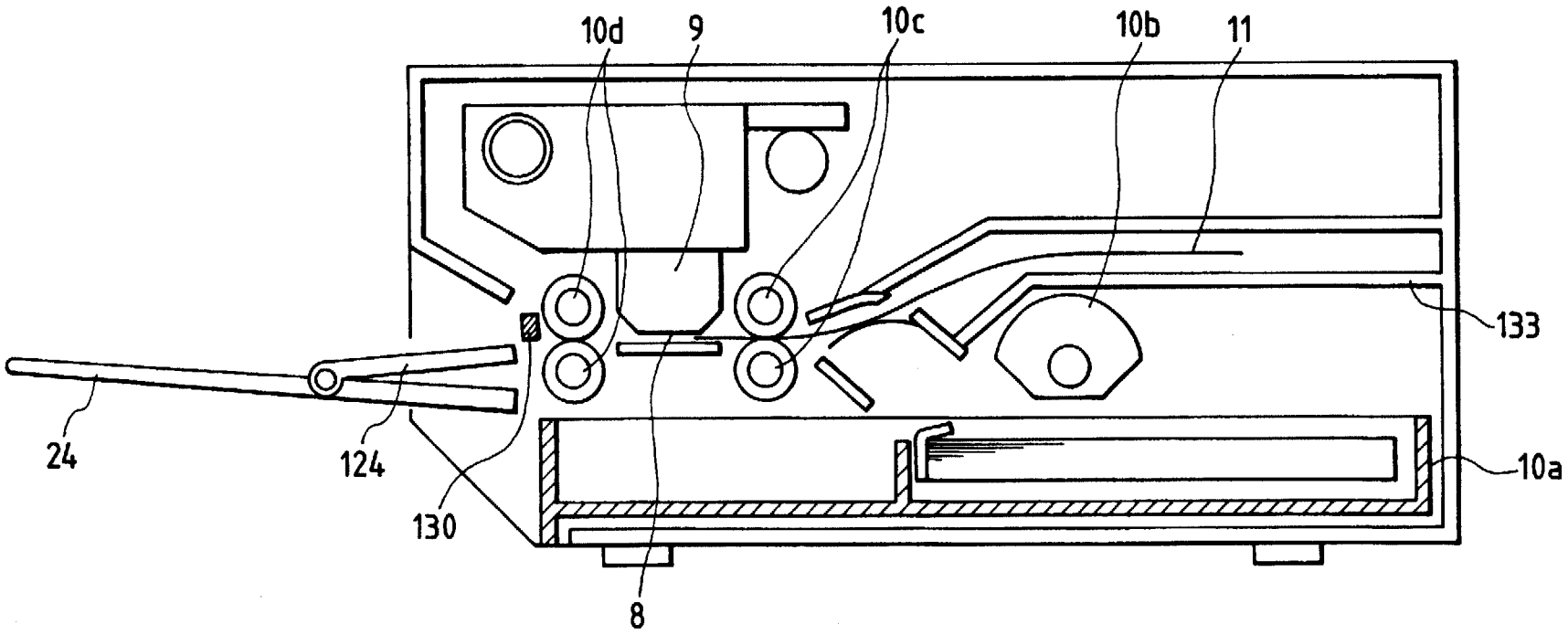

In the fourth embodiment, a case will be exemplified wherein a recording medium is fed by a switch-back type manual sheet insertion method. FIGS. 11 and 12 are schematic sectional views of a printer of the fourth embodiment, and FIG. 13 is a flow chart for explaining the operation of the printer.

Referring to FIG. 11, a manual sheet insertion switch (not shown) is depressed to raise a manual sheet insertion guide 124. The guide 124 is raised by mechanically cooperating the manual sheet insertion switch, a cam, and the like (S-51 in FIG. 13). Subsequently, a user inserts a sheet 11 on a sheet ejection tray 12 until it abuts against sheet ejection rollers **10*d*. When a microswitch 130 detects the sheet, the sheet ejection rollers 10*d* and sub-scanning rollers 10*c* are rotated by a predetermined number of revolutions in the reverse direction to pull in the sheet onto a manual sheet insertion table 133 (S-52). The number of revolutions is set, so that the trailing end portion, when viewed from the user, of the sheet is clamped between the rollers 10*c* upon completion of the pull-in operation, as shown in FIG. 12. In this case, the sheet is fed, so that a transparent portion 105** is located at the trailing end portion of the sheet when viewed from the user.

Figure 10:
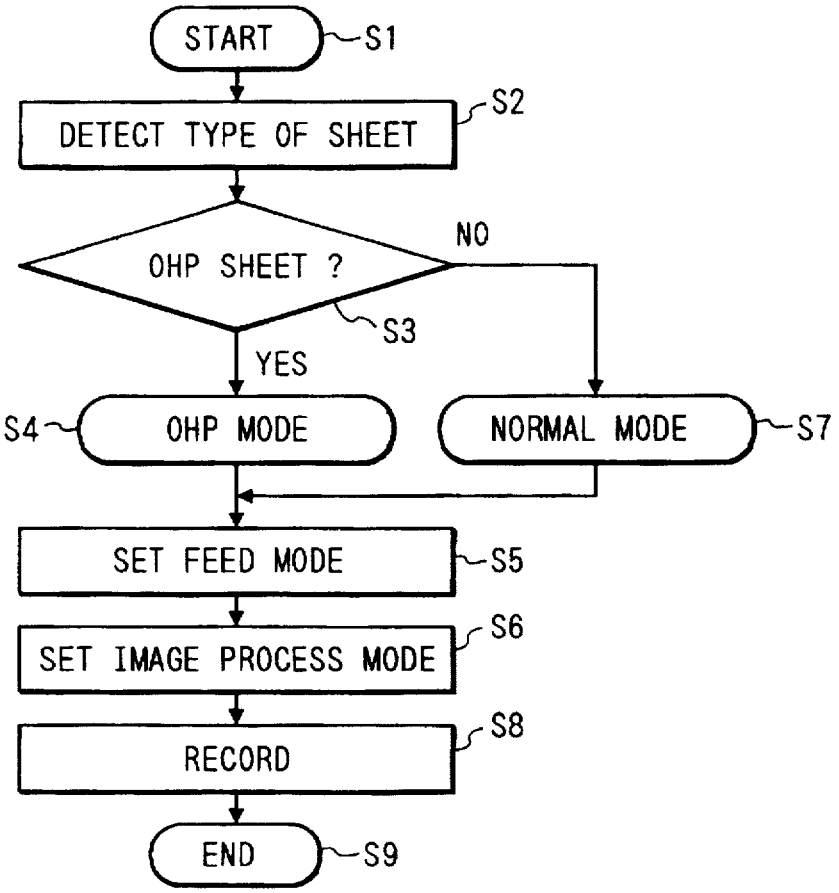
FIG. 10 is a flow chart for explaining the recording operation of the present invention.

Then, the type of sheet is detected in the same sequence as in FIG. 10 (S-53). Subsequently, print and sheet ejection operations are performed in the same manner as in a cassette feed mode in a sequence according to the detected type of sheet (S-54).

In this case, the transparent portion 105 of the sheet is located at the trailing end side when viewed from the user. This means that, in a manual sheet insertion mode, the user inserts the sheet such that its end portion without the transparent portion 105 abuts against the sheet ejection rollers. As can be seen from FIGS. 1, 6, 7, and 9, the transparent portion has a different stiffness since it has a thickness different from the remaining portion. In the structure shown in FIG. 6 or 7, the transparent portion may be bent depending on attaching precision of the transparent portion. In such a case, sheet detection using the microswitch 130 may fail, or the leading end portion cannot be clamped between the sheet ejection rollers 10*d*, thus causing paper jam. In the sheet feed method of this embodiment, since the transparent portion 105 need not abut against the rollers, the sheet feed operation can be reliably performed. With this method, since a completely straight sheet feed path can be realized, paper jam does not easily occur even when the thickness or stiffness of the sheet largely changes.

In each of the above embodiments, a golden film has been exemplified. However, the base is not limited to this, and includes many variations such as a golden film, a white film, cloth, and the like.

Also, the layer structure may include many variations. For example, an undercoating layer for improving adhesion may be inserted between the base and the ink absorption layer. Therefore, the base and the ink absorption layer need not always be in direct contact with each other. In other words, the absorption layer need only be present at least above the base.

The position of the transparent layer is not limited to the leading end position, but includes many variations such as the right end portion, the trailing end portion, and the like depending on the detection position or timing in the apparatus.

For example, in a machine which performs detection at the position shown in FIG. 8, a hatched portion or a portion wider by 1 to 2 mm than the hatched portion need only be a transparent portion.

Also, the method of manufacturing the above-mentioned recording medium is not limited to the above-mentioned method. For example, a method of manufacturing a white film-like recording medium will be exemplified below.

Figure 9:
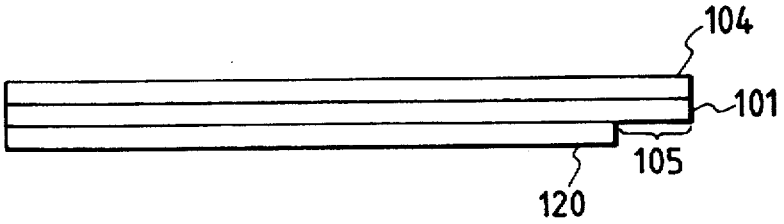
FIG. 9 is a sectional view for explaining another manufacturing method of the embodiment.

Referring to FIG. 9, a transparent PET film 101 and a transparent ink absorption layer 104 are stacked on a white printed ink layer 120. More specifically, the rear surface of a transparent recording medium is printed in white, thus manufacturing a white film-like recording medium. At this time, when the print operation is performed using a plate which does not print a transparent portion 105 in white, a recording medium having a transparent portion can be easily manufactured. Furthermore, only the hatched portion in FIG. 8 can be easily formed to be a transparent portion by using another plate.

In place of printing, a white film, a golden film, a silver film, or the like may be laminated from the rear surface.

As described above, according to the present invention, since even an opaque sheet can be subjected to recording in the same mode as a transparent OHP sheet, deterioration of image quality can be prevented.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode manly with black, a multi-color mode with different color ink materials and/or a full-color mode using the mixture of the colors, which may be an integrally formed recording unit or a combination of plural recording heads.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording medium for an ink jet recording apparatus having detection means for optically detecting a type of recording medium, and means for selecting a recording mode compatible with the detected type of recording medium from a plurality of recording modes, in accordance with the detected type of recording medium, comprising:

a recording portion prepared by stacking an opaque base and a transparent ink absorption layer; and a detection portion which is at least transparent and corresponds with a detection position of said detection means, wherein said detection portion is provided at a position where said detection portion is detected by said detection means while said ink jet recording medium is in said ink jet recording apparatus so that said recording mode selecting means may select the recording mode before said ink jet recording apparatus starts recording, and wherein said detection portion is provided at a position so as not to overlap said recording portion in a direction of the thickness of said recording medium.

2. A medium according to claim 1, wherein said detection portion is removably adhered to said recording portion.

3. A medium according to claim 2, wherein said detection portion comprises a transparent film.

4. A medium according to claim 1, wherein said detection portion has an ink absorption layer.

5. A medium according to claim 1, wherein said detection portion is subjected to recording with an ink ejected using thermal energy.

6. A medium according to claim 1, wherein said base comprises a golden film.

7. A medium according to claim 1, wherein said base comprises a silver film.

8. A medium according to claim 1, wherein said base comprises a white film.

9. A medium according to claim 1, wherein said recording portion has a transparent ink absorption layer stacked on an opaque base prepared by forming an opaque dyestuff layer on a transparent film, and said detection portion comprises an extention of said transparent film.

10. A medium according to claim 1, wherein said recording portion has a transparent ink absorption layer stacked on one surface of a transparent film and an opaque dyestuff layer stacked on the other surface of said transparent film, and said detection portion comprises an extension of said transparent film and said transparent ink absorption layer.

11. A medium according to claim 1, wherein said ink absorption layer has ink absorption properties inferior to paper.

12. An ink jet recording medium comprising:

a recording portion prepared by stacking an opaque base and a transparent ink absorption layer; and a transparent detection portion, wherein said detection portion is provided at a position so as not to overlap said recording portion in a direction of the thickness of said recording medium.

13. A medium according to claim 12, wherein said ink absorption layer has ink absorption properties inferior to paper.

14. A method for selecting a recording mode compatible with a type of recording medium from a plurality of recording modes, comprising the steps of:

providing an ink jet recording medium comprising (1) a recording portion prepared by stacking an opaque base and a transparent ink absorption layer and (2) a detection portion which is at least transparent and corresponds with a detection position of a detection means;

detecting optically a type of said recording medium; and selecting a recording mode compatible with a transparent recording medium, wherein said detection portion is provided at a position so as not to overlap said recording portion in a direction of the thickness of said recording medium.

* * * * *

UNITED STATES PATENT AND TRADEMARK OFFICE

CERTIFICATE OF CORRECTION

PATENT NO. : 5,734,405

DATED : March 31, 1998

INVENTOR(S) : AKIO SUZUKI

It is certified that error appears in the above-identified patent and that said Letters Patent is hereby corrected as shown below:

Column 1

Line 44, "scattering-of" should read --scattering of--.

Column 12

Line 3, "extention" should read --extension--.

Signed and Sealed this

Fifth Day of January, 1999

*Attest:*

*Attesting Officer*

*Acting Commissioner of Patents and Trademarks*